US005874874A

United States Patent [19]

Helms et al.

[11] Patent Number: 5,874,874

[45] Date of Patent: Feb. 23, 1999

[54] SPRING BIASED MOVABLE LAMINATED CONTACT ARM CONDUCTOR ASSEMBLY

[75] Inventors: Roger W. Helms, Beaver Falls; Joseph B. Humert, Monaca; Henry R. Beck, Coraopolis; David E. Little, Beaver Falls; Kenneth M. Fischer, Finleyville, all of Pa.

[73] Assignee: Eaton Corporation, Cleveland, Ohio

[21] Appl. No.: 55,612

[22] Filed: Apr. 6, 1998

Related U.S. Application Data

[62] Division of Ser. No. 832,492, Apr. 3, 1997, Pat. No. 5,847,629.

[51] Int. Cl.[6] ..... H01H 75/00

[52] U.S. Cl. ..... 335/16; 200/244; 218/22

[58] Field of Search ..... 200/244, 246; 218/22, 26, 27; 335/16, 147, 195

[56] References Cited

U.S. PATENT DOCUMENTS

| | | | |
|---|---|---|---|
| 4,571,565 | 2/1986 | Belbel et al. | 335/16 |
| 5,032,813 | 7/1991 | Gula et al. | 200/244 |
| 5,337,031 | 8/1994 | Castonguay et al. | 335/201 |
| 5,552,754 | 9/1996 | Sharaf | 335/16 |

*Primary Examiner*—Lincoln Donovan
*Attorney, Agent, or Firm*—Martin J. Moran

[57] ABSTRACT

The helical contact compression springs of a circuit breaker are preassembled in a contact clip for easier assembly of the circuit breaker. The bottom wall of an elongated trough formed by the clip is pierced by holes forming cylindrical protrusions extending into the trough. The clip is placed over the springs supported in a row in a fixture. A die head presses on the spring clip to compress all the springs and then simultaneously insert punches into the holes in the clip to expand the protrusions and secure the springs to the clip. The fixture includes a slide mounted on guides for movement between a loading position and an operating position under the die head. A support block is pivoted on the slide to present one of two sets of spring recesses for circuit breakers having different current ratings with the slide in the loading position.

1 Claim, 10 Drawing Sheets

SPRING BIASED MOVABLE LAMINATED CONTACT ARM CONDUCTOR ASSEMBLY

This is a division of application Ser. No. 08/832,492 filed Apr. 3, 1997, now U.S. Pat. No. 5,847,629.

BACKGROUND OF THE INVENTION

1. Field of the Invention

This invention relates to circuit breakers having a contact arm spring subassembly for providing pressure to maintain the contacts closed, and to a method and apparatus for making the subassembly to simplify the assembly of the circuit breaker.

2. Background Information

Molded case circuit breakers have a moveable contact mounted on a contact arm which is pivoted by a carrier between a closed position in which the moveable contact contacts a fixed contact to connect a protected circuit to a source and an open position in which current to the load is interrupted. Typically, the contact arm is made up of a stack of copper laminations supported in the carrier to operate as a single conductor. Contact springs are provided in the carrier to apply contact pressure to the contacts when they are closed and to allow for contact wear. Typically in molded case circuit breakers, arcing contacts are provided in addition to the main contacts. The springs for the contact arm laminations carrying the arcing contacts are selected such that the arcing contacts do not separate until after the main contacts open. With this arrangement, the arcing contacts take the major wear associated with interrupting the arcs which are struck when interrupting large currents.

In some molded case circuit breakers, the contact springs are supported in a contact spring clip. This contact spring clip is an elongated channel member having a series of cone shaped protrusions punched into the bottom wall which serve to locate the individual helical compression springs for alignment with the respective contact arm laminations. The contact arm laminations, the carrier, and the contact spring clip and individual springs are assembled along with flexible shunts, shunt plates, and barriers between the laminations to form a moving conductor assembly. Currently, it is difficult to maintain the proper position of all of the parts, and especially the springs, while making the assembly. While the cone shaped protrusions in the spring clip provide a point of reference for the springs, they are not visible throughout assembly. As a result, the springs could be misaligned, or possibly drop out without notice. These assembly problems directly affect product cost due to additional assembly time needed to assure proper spring retention and alignment. Rework resulting from mislocated and missing springs and disassembly of misassembled product is significant. Multi-phase circuit breakers require separate moving conductor assemblies for each phase, which compounds the problem.

There is a need, therefore, for an improved circuit breaker which can be assembled easily and reliably.

There is a concurrent need for an improved method and apparatus for assembling multi-phase circuit breakers having multiple contact springs for each moving conductor assembly.

There is a related need for an improved subassembly of contact springs and an associated spring clip to facilitate assembly of the circuit breaker.

There is also a need for such a method and apparatus which are flexible enough to easily accommodate assembly of circuit breakers having different numbers of contact springs.

SUMMARY OF THE INVENTION

These needs and others are satisfied by the invention which includes a contact arm spring subassembly which can be handled as a single part. This subassembly includes a spring clip comprising an elongated U-shaped channel member having a bottom wall and side walls forming a trough and with a plurality of pierced holes spaced along the bottom wall forming cylindrical protrusions projecting into the trough. Helical compression springs are seated on the cylindrical protrusions which are then expanded to secure the spring to the protrusion. This novel subassembly not only properly positions the contact springs, but prevents them from falling out or becoming misaligned during assembly of the moving conductor assembly.

The invention includes the method of making the contact arm spring subassembly by forming a piece of sheet material into the spring clip comprising the elongated U-shaped channel member having a bottom wall and side walls forming a trough, piercing the bottom wall to form a plurality of spaced apart cylindrical protrusions projecting into the trough, seating the helical contact compression springs on the protrusions and expanding the protrusions to secure the springs to the spring clip. This assembly process is preferably carried out by supporting the springs in a fixture, placing the spring clip over the springs and the fixture, and then expanding the protrusions while the springs are thus supported in the fixture. Most preferably, all of the protrusions are expanded simultaneously with a tool having a separate expander for each of the protrusions. It is also preferred that the spring clip be pressed down to compress all of the springs prior to expanding the protrusions.

The apparatus for assembling the contact arm spring subassembly includes a fixture having a plurality of recesses aligned in a row in which the helical compression springs are seated with the springs projecting above the fixture. The spring clip is placed over the springs with the protrusions extending into the springs. A die head having a plurality of punches is aligned in spaced relation to the spaced holes in the spring clip. Means for imparting relative movement between the die head and the fixture insert the punches into the holes in the protrusions. The punches are configured to expand the protrusions laterally to form an interference fit with the springs.

The fixture includes a support in which the springs are supported and a slide on which the support is mounted for sliding between a loading position in which the springs and the spring clip are loaded and operating position in which the support is aligned for insertion of the punches into the protrusions. Each of the punches comprises a cylindrical shaft smaller in diameter than the holes forming the protrusions and having diametrically opposite lateral projections greater in diameter than the holes forming the protrusions.

The apparatus of the invention may be adapted for making contact spring subassemblies having different numbers of contact springs. The support includes a first set of recesses for subassemblies having a first plurality of springs and a second set of recesses for subassemblies having a second plurality of springs. A selector means selectively positions the support on the slide such that the selected first or second set of recesses is aligned with the punches when the support is in the operating position. Preferably the selector means comprises a pivot, pivotally supporting the support on the slide for rotation between the first position in which the first set of recesses is selected and in a second position in which the second set of recesses is selected.

Also preferably, the fixture includes aligning means which align the spring clip to bring the protrusions into register with the springs retained in the recess. This aligning means may comprise an elongated projection on the fixture configured to engage the trough and the spring clip in which the recesses are formed. This aligning means can further include end guides longitudinally positioning the spring clip relative to the springs.

In addition, it is preferable that the die head include a stripper spring biased to extend beyond the punches and engage the spring clip to compress the plurality of springs and seat the spring clip on the projection before the punches engage the holes in the protrusions.

The invention also extends to a circuit breaker which includes a housing, separable contacts, including fixed contact, removable contacts, a moveable conductor assembly which includes, a set of movable contact arm laminations to which the moveable contacts are affixed, and a contact arm carrier assembly pivotally mounted within the housing of the circuit breaker and on which the contact arm laminations are pivotally mounted. The carrier assembly includes the contact arm spring subassembly as previously described.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

The invention is directed to a circuit breaker contact arm spring subassembly and a circuit breaker incorporating such a subassembly. The invention is further directed to a method and apparatus for making the subassembly. The circuit breaker is a molded case circuit breaker of the type described in U.S. Pat. No. 5,341,191, which is hereby incorporated by reference. Such circuit breakers are typically threephase; however, for simplicity only the center pole is described in detail and illustrated. Furthermore, only the pertinent parts of the circuit breaker will be illustrated and described in detail.

Figure 1:
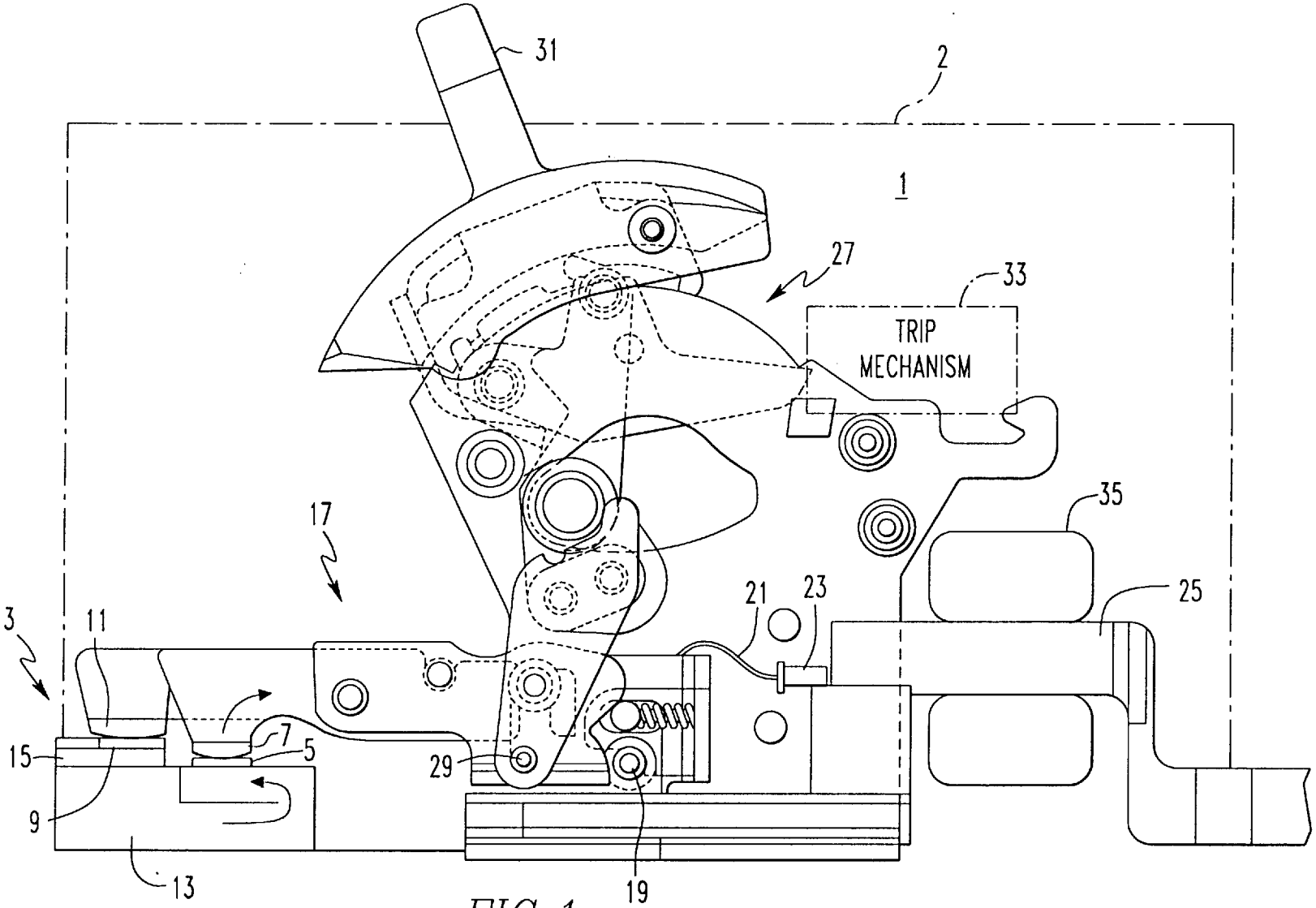
FIG. 1 is a longitudinal sectional view through a circuit breaker in accordance with the invention.

Referring to FIG. 1, the circuit breaker 1 includes an electrically insulative housing 2. Mounted within the housing 2 for each pole is a set of separable contacts 3, including a fixed main contact 5 and a moveable contact 7. In addition, a fixed arcing contact 9 and movable arcing contact 11 can be provided. The fixed main contact 5 is secured to a line conductor 13, which terminates in a line side terminal (not shown). The fixed arcing contact 9 is mounted on a metal conductor 15 on top of the line conductor 13 so that the fixed arcing contact 9 is above the fixed main contact 5. The movable main contact 7 and movable arcing contact 11 are carried by a moving conductor assembly 17. The moving conductor assembly 17 is pivotally mounted for rotation by pivot pin 19. Flexible braided wire shunts 21 electrically connect the moving conductor assembly 17 to a shunt pad 23 connected to a load side conductor 25 which terminates in a load terminal (not shown). Thus, with the circuit breaker in the on position shown in FIG. 1, in which the separable contacts 3 are closed, electrical continuity is provided from the line terminal (not shown) through the line conductor 13 the separable contacts 3, the movable contact arm assembly 17, the flexible braided wire shunts 21, the shunt pad 23, and the load side conductor 25 to the load terminal (not shown).

The moving conductor assembly 17 can be rotated by a spring driven operating mechanism 27 which is described in detail in U.S. Pat. No. 5,341,191, and is of a type well known in the art. The operating mechanism 27 is pivotally connected to the moving conductor assembly 17 by a pivot pin 29. The separable contacts 3 can be opened and closed manually by a handle 31 which forms part of the spring driven operating mechanism 27. Rotation of the handle 31 from the ON position shown in FIG. 1 in which the separable contacts are closed counterclockwise to the OFF position (not shown) results in opening of the separable contacts through rotation of the moving conductor assembly 17, as is well known. The spring driven operating mechanism 27 includes a trip mechanism shown schematically at 33 which responds to certain overcurrent conditions to operate the circuit breaker to the tripped position (also not shown). The trip mechanism 33 is preferably an electronic trip which responds to load current measured by a current transformer 35 inductively coupled to the load conductor 25. Alternatively, the trip mechanism 33 can be a well known thermal-magnetic trip device.

Figure 2:
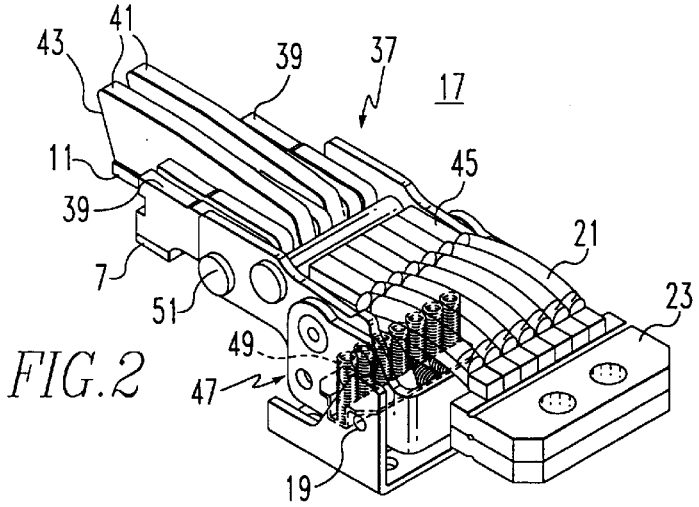
FIG. 2 is an isometric view of a contact arm assembly of the circuit breaker of FIG. 1 with parts cut away showing a contact arm spring subassembly which is a subject of the present invention.
Figure 3:
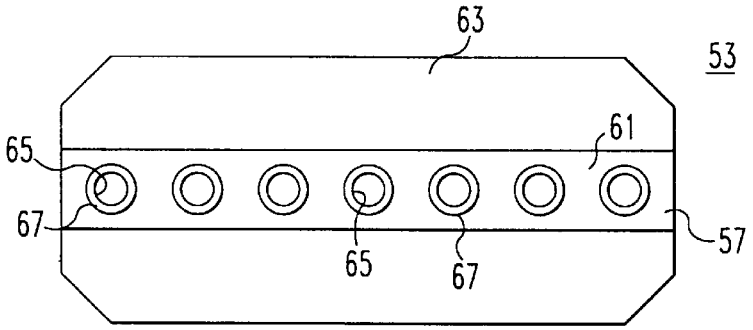
FIG. 3 is a plan view of a spring clip which forms part of the contact arm spring subassembly.
Figure 4:
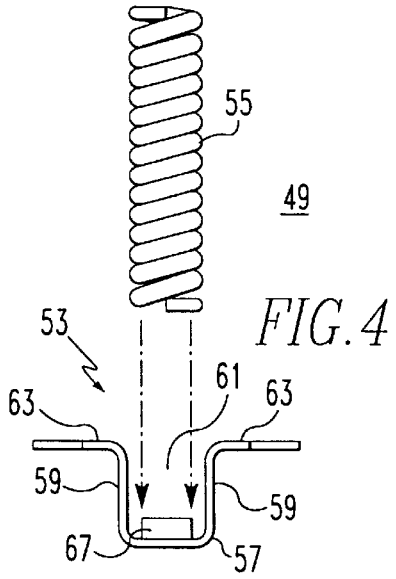
FIG. 4 is an end view of the clip of FIG. 3, together with a spring which forms part of a contact arm spring subassembly of the invention.

FIG. 2 illustrates in more detail the moving conductor assembly 17. This assembly 17 includes a moveable contact arm 37 formed by a number of main moveable contact arm laminations 39 and longer, arcing moveable contact arm laminations 41. The number of each type of lamination depend upon the current rating of the particular circuit breaker. FIG. 2 shows a moving conductor assembly 17 having five main contact arm laminations 39 and two arcing moveable contact arm laminations 41. For lower rated moveable contact arms 37, for instance having only five total main and arcing laminations, spacer laminations (not shown) are provided in place of the outer laminations to standardize the remaining parts of the assembly 17. The moveable main contact 7 and moveable arcing contact 11 are brazed to a first or free end 43 of the moveable contact arm 37 at the main moveable contact arm laminations 39 and arcing moveable contact arm laminations 41, respectively. The flexible braided wire shunts 21 are brazed to second ends 45 of the contact arm laminations.

The second end 45 of the moveable contact arm 37 is pivotally supported for rotation about the pivot pin 19 by a contact arm carrier assembly 47. This contact arm carrier assembly 47 includes a contact arm spring subassembly 49 which biases the contact arm laminations 39 and 41 about a second pivot pin 51 to maintain contact pressure on the separable contacts 3 when the circuit breaker is closed as shown in FIG. 1.

Referring to FIGS. 3, 4, 5*a*, 5*b* and 6, the contact arm spring subassembly 49 includes a spring clip 53 and a plurality of helical contact compression springs 55, one for each of the laminations of the contact arm 37. The spring clip 53 is an elongated U-shaped channel member formed from sheet material and has a bottom wall 57 and side walls 59 forming a trough 61. Flanges 63 extend laterally outward from the free ends of the side walls. The bottom wall is pierced and extruded to form a plurality of holes 65 with cylindrical protrusions 67 extending into the trough 61. The protrusions 67 are spaced along the bottom wall 57 for proper spacing of the springs 55 to align with the associated lamination of the contact arm 37. As discussed above, currently cone shaped projections are provided in a bottom wall of a spring clip. These projections only help to align the springs and do not grip the springs so that the springs remain as separate items. It can be appreciated that the assembly of the moving conductor assembly 17 with the many parts, including the loose contact springs such as 55, is not easy, and may result in misaligned springs which would require rework of the assembled circuit breaker.

Figure 5A:
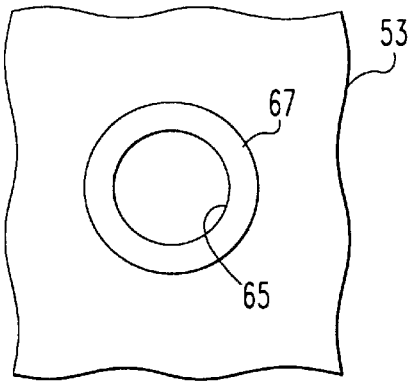
FIG. 5*a* is a plan view of a protrusion formed on the clip shown in enlarged scale and before expansion in accordance with the invention.
Figure 5B:
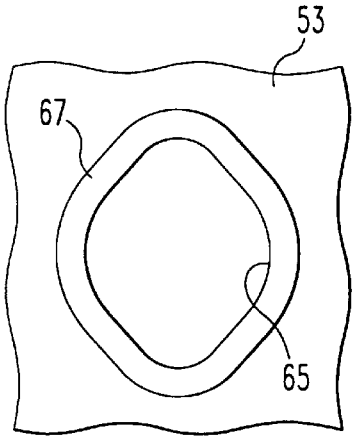
FIG. 5*b* is a plan view of the protrusion of FIG. 5*a* shown after expansion.
Figure 6:
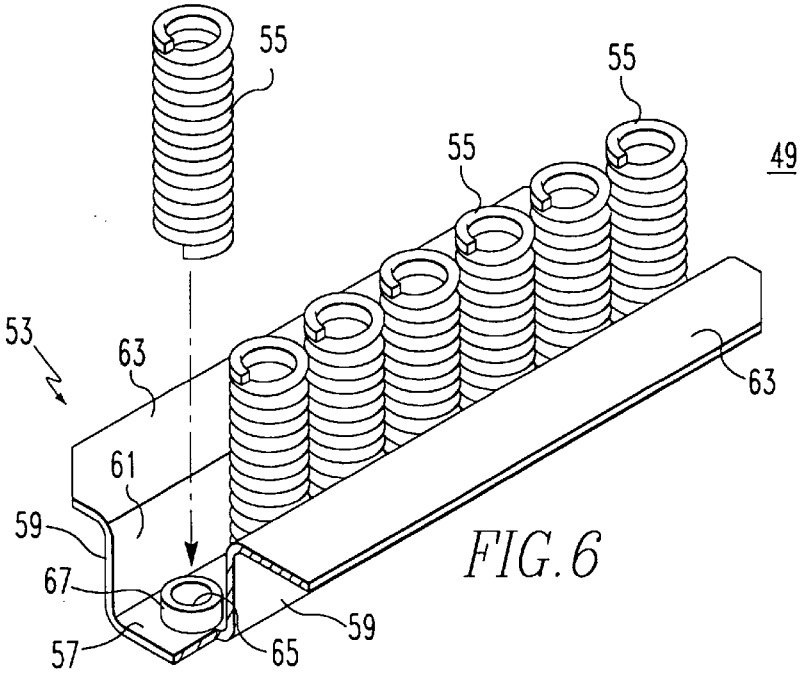
FIG. 6 is a partially exploded isometric view of a completed contact arm spring subassembly in accordance with the invention.
Figure 7:
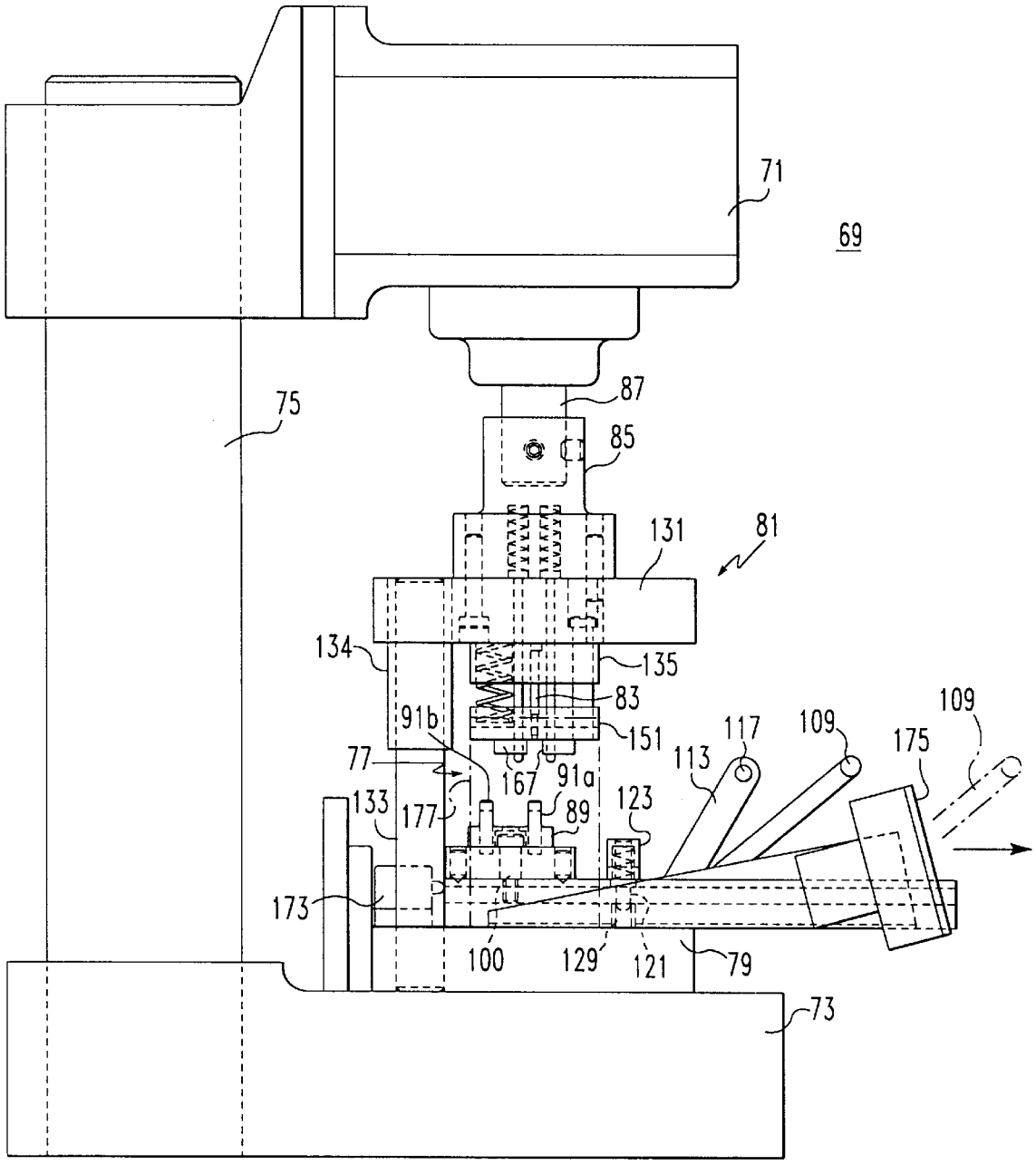
FIG. 7 is a side elevation view of apparatus in accordance with the invention for assembling the contact arm spring subassembly of FIG. 6.
Figure 8:
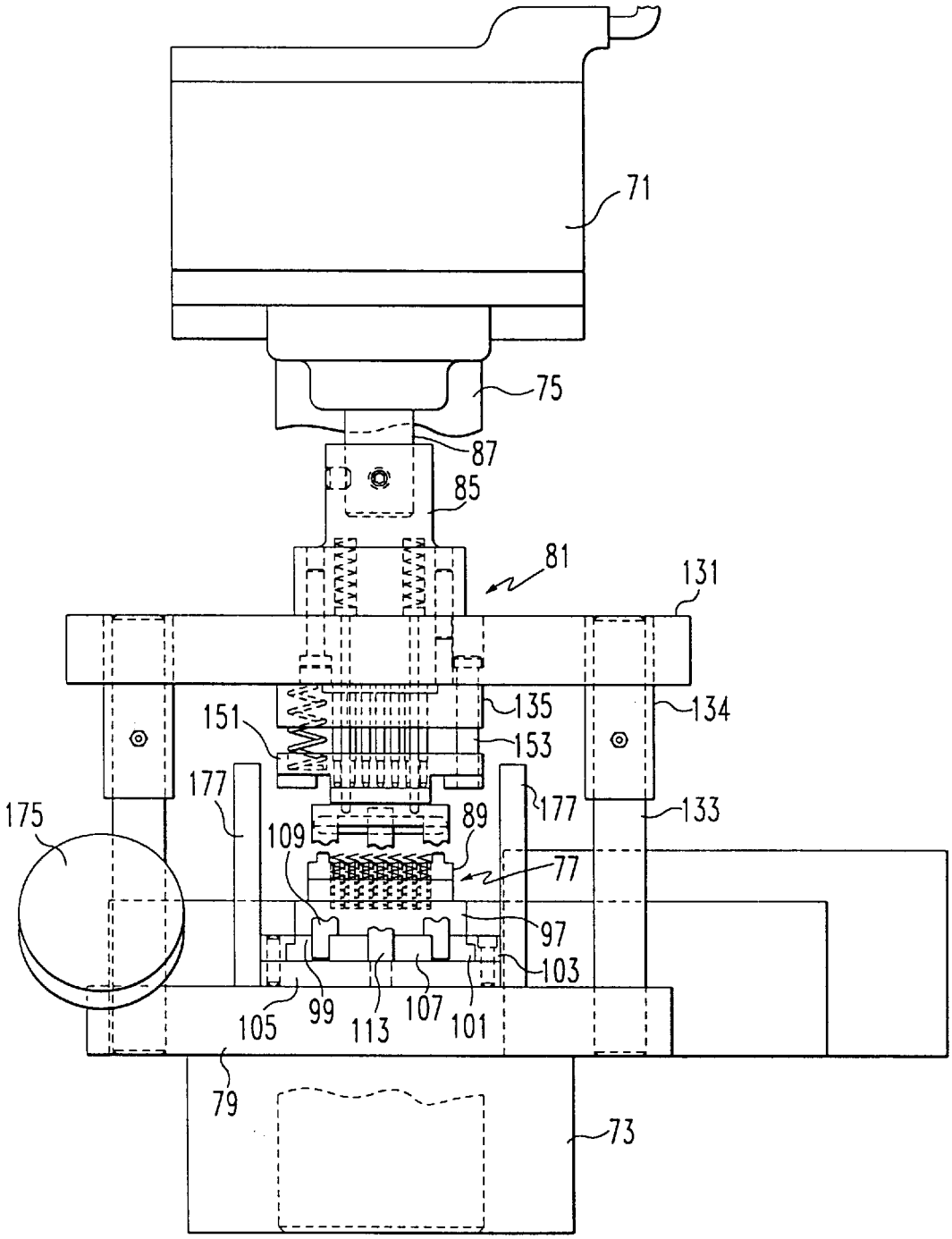
FIG. 8 is a front elevational view of the apparatus of FIG. 7.

In accordance with the invention, the helical compression springs 55 are seated on the cylindrical protrusions 67, and punches are inserted through the holes 65 to expand the protrusions laterally to create an interference fit between the springs and the protrusions. As shown in FIG. 5*a*, the protrusions 67 when initially formed are cylindrical. In the exemplary embodiment of the invention, the protrusions are expanded along a diameter to the shape shown in FIG. 5*b* which results in an interference fit with the internal surface of the helical contact compression springs 55. The resultant contact arm spring subassembly 49 is shown in FIG. 6. With the springs 55 and clip 53 integrated as a subassembly, proper alignment of the springs is assured and the springs cannot drop out during the subsequent assembly of the moving conductor assembly 17.

In summary, the process for making the contact arm spring subassembly 49 includes:

1. Forming a piece of sheet material into a spring clip 53 in the form of an elongated U-shaped channel member having a bottom wall 57, and side walls 59 forming a trough 61 and with the bottom wall 57 pierced to form a plurality of spaced apart cylindrical protrusions 67 projecting into the trough 61;
2. Seating a helical contact compression spring 55 on each of the protrusions 67; and
3. Expanding the protrusions 67 to secure the springs 55 to the spring clip 53.

Apparatus 69 for assembling the contact arm spring subassemblies 49 in accordance with this procedure, is shown in FIGS. 7–16. Apparatus 69 includes a pneumatic press 71 supported above the base 73 by a support column 75. A fixture 77 supporting the springs 55 and spring clip 53 in a manner to be described is movably mounted on a bottom die shoe 79 secured to the base 73. A tool in the form of die head 81 carrying expanders in the form of punches 83 for expanding the protrusions 67 is reciprocated toward and away from the fixture 77 by the pneumatic press 71. This die head 81 includes a collar 85 secured to an operating shaft 87 depending downwardly from the press 71.

Figure 9:
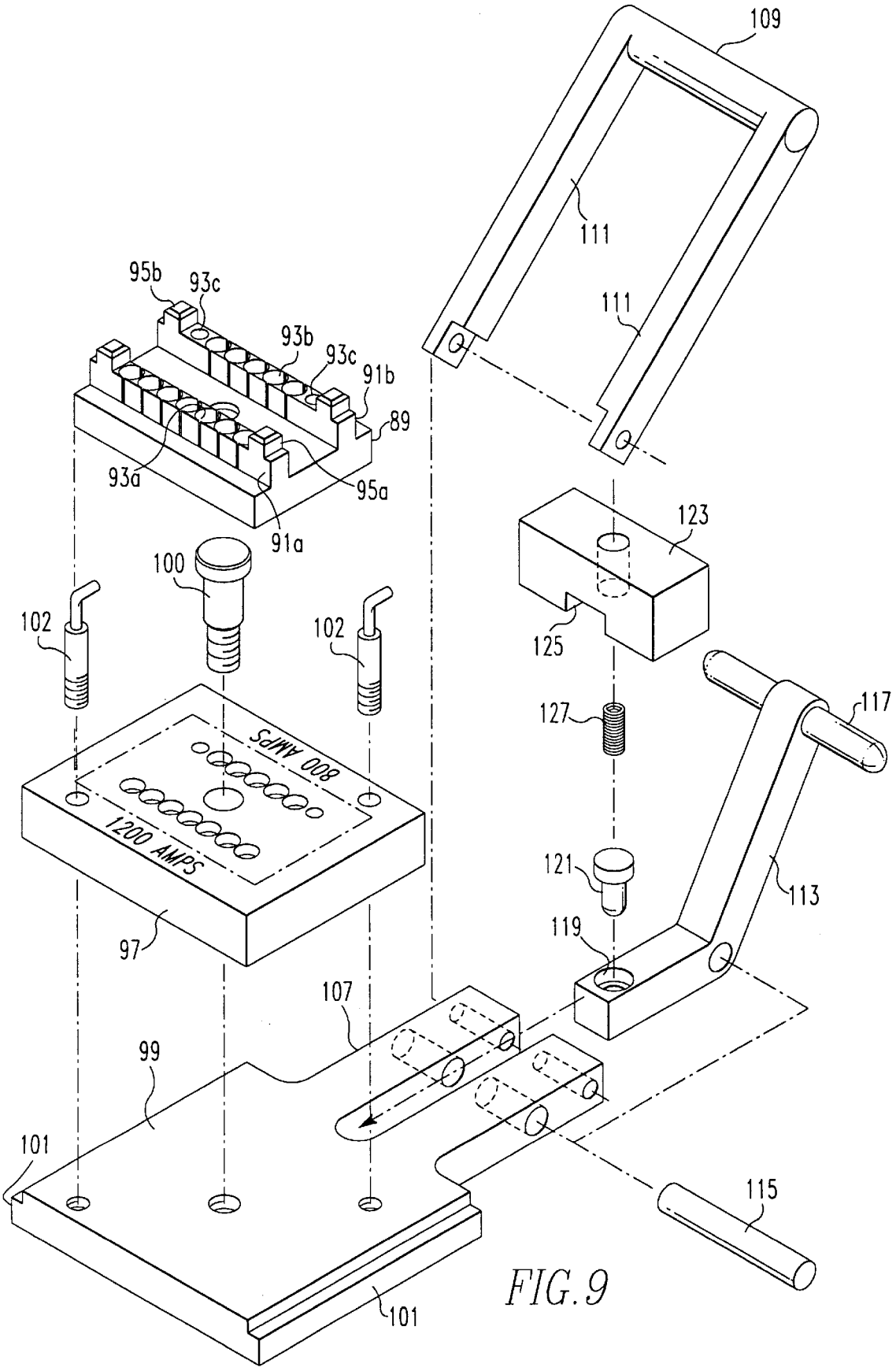
FIG. 9 is an exploded isometric view of a slide assembly which forms part of the apparatus of FIGS. 7 and 8.
Figure 12:
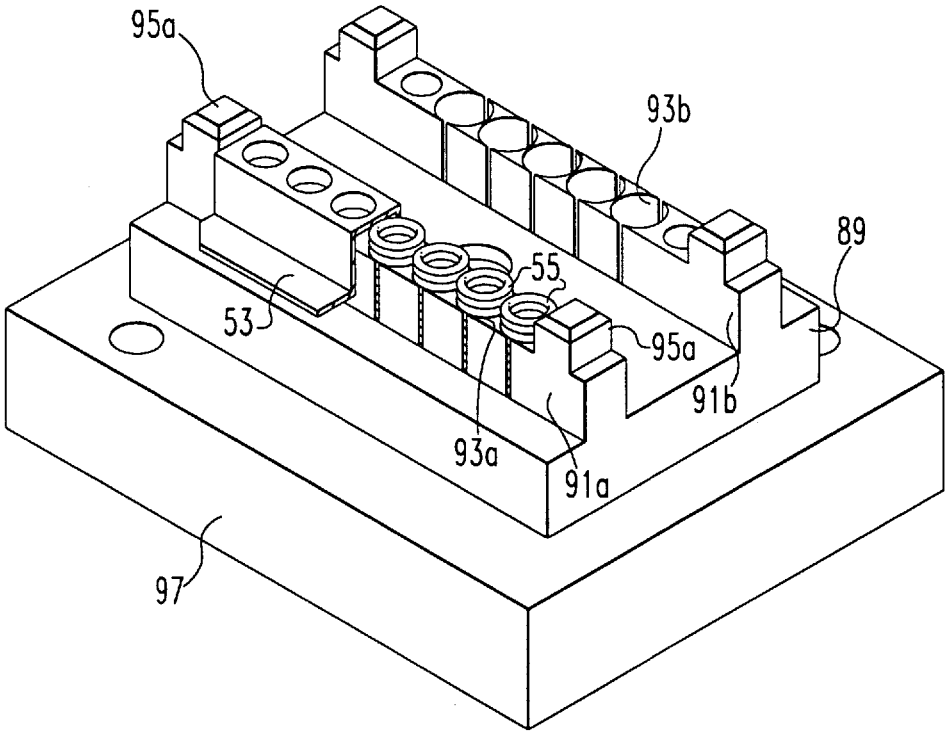
FIG. 12 is an isometric view of a spring block which forms part of the slide assembly of claim 9, shown with a set of springs in place and a spring clip aligned for assembly.
Figure 14:
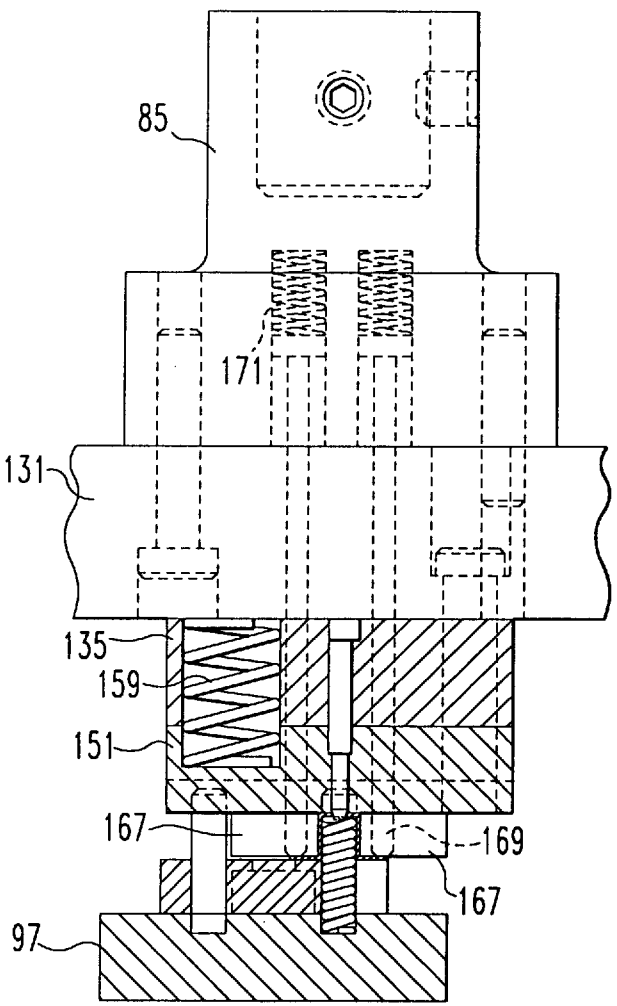
FIG. 14 is a cross-section through FIG. 13.
Figure 13:
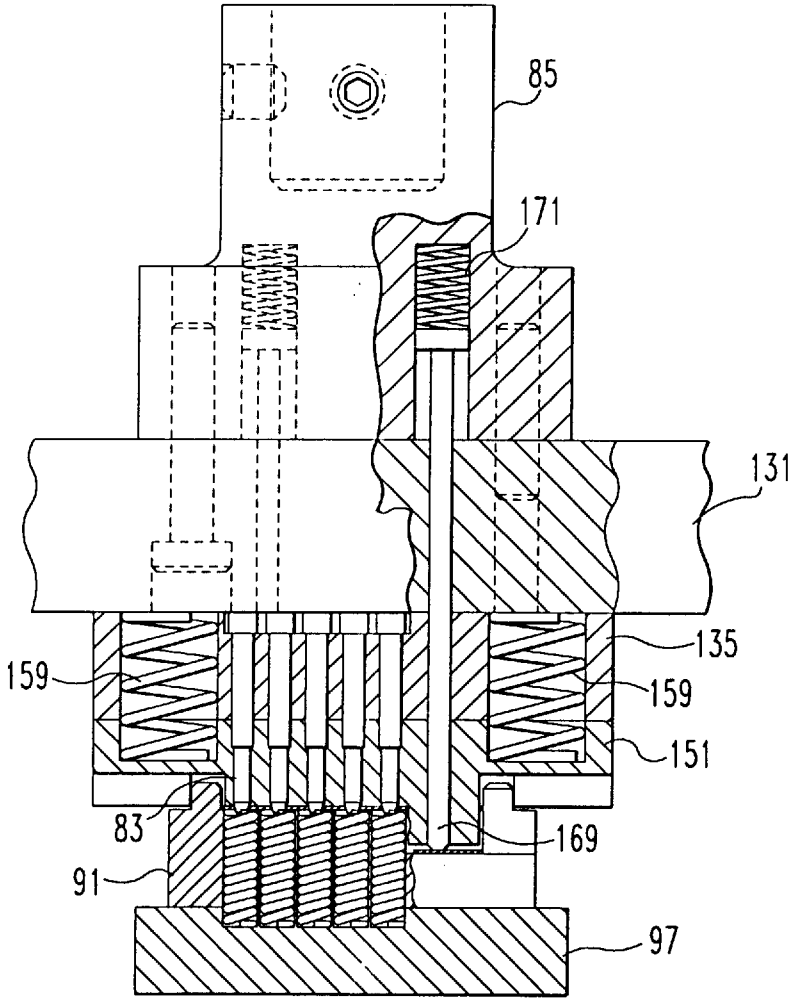
FIG. 13 is a vertical cross-section through the apparatus shown with the punches engaging the protrusions for expanding them into contact with the springs.

The fixture 77 includes a support block 89 adapted for assembling subassemblies 49 having either five or seven springs 55. To this end, the support block 89 has two spaced apart, parallel, elongated raised members 91*a* and 91*b*, having a cross-section complimentary to the cross-section of the trough 61 of the spring clip. Spaced along the elongated member 91*a* are seven spring recesses 93*a*, as best seen in FIGS. 9 and 12. At the ends of the raised member 91*a* are posts 95*a* which help to longitudinally position the spring clip 53 as will be seen. The raised member 91*b* has five recesses 93*b* sized to receive five helical springs 55. Additional recesses 93*c* are provided in the elongated member 91*b* to serve as blind holes for the additional two punches which are not needed in the contact arm spring subassembly for the circuit breaker with a lower current rating. These blind holes 91*c* are made smaller in diameter so that springs may not be inadvertently seated in them.

The support block 89 is secured to a support block plate 97 which is larger than the support block. Indication of the current rating of the circuit breakers, for which the subassemblies 49 are assembled on the two elongated supports 91*a* and 91*b*, are marked on the support block plate 97 for the convenience of the operator. For the exemplary apparatus, this is 1200 and 800 amperes, respectively.

The support formed by the support block 89 and support block plate 97 is pivotally mounted as a unit on a slide 99 by a pivot pin 100 as best seen in FIG. 9. The support block 89 is secured in one of two rotational positions by threaded locking clamps 102, which extend through opposite corners of the support plate 97 and engage the slide 99. The slide 99 is rabbetted along its lateral edges to form rails 101 which are captured by undercut guides 103 mounted on a slide base plate 105 secured to the bottom die shoe 79. See FIG. 8. The slide 99 has a bifurcated extension 107. A slide handle 109 is secured to the bifurcated extension 107 by a pair of handle supports 111. By grasping the slide handle 109 an operator can move the slide from the operating position shown in FIG. 7 in which the fixture 77 is aligned with the die head 81 and a loading position indicated in phantom in FIG. 7 in which the slide is drawn out from under the die head for easier, safe access by the operator for loading and unloading. A locking arm 113 having two sections extending from each other at an obtuse angle is pivotally mounted at its apex in the slot form by the bifurcated extension 107 by a pivot pin 115. A locking handle 117 is secured to the free end of the locking arm 113. The other end of the locking arm has a counterbored aperture 119, which receives a locking pin 121. A spacer block 123 is bolted to the bifurcated extension 107 on the slide across the slot therein and has a groove 125 aligned with the slot and the locking pin 121. A helical compression spring 127 seated in the spacer block 123 biases the locking pin 121 downward. When the slide is pushed forward into the operating position, the locking pin drops into a recess 129 (see FIG. 7) in the slide base plate 105 thereby accurately and securely positioning the fixture 77 relative to the die head 81. To withdraw the slide 99 to the loading position, the operator presses down on the locking handle 117 to disengage the locking pin 121, so that the slide can be retracted by the slide handle 109.

The die head 81 includes a top die shoe 131 secured to the collar 85. The fixed alignment of the top die shoe 131 with the bottom die shoe 79 is assured by a pair of guide posts 133 fixed in the bottom die shoe 79 and which engage guide sleeves 134 on a top die shoe 131.

Figure 11:
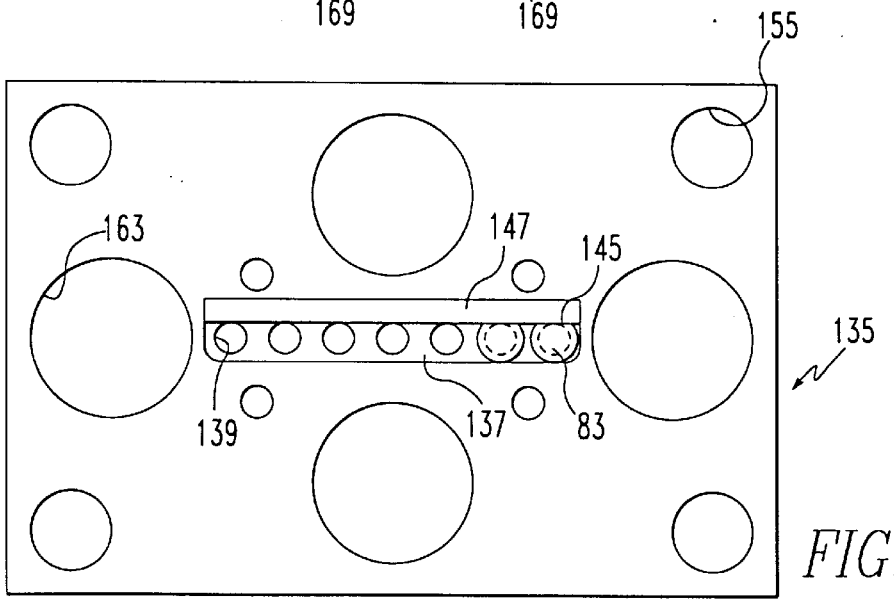
FIG. 11 is a top plan view of a punch holder which forms part of the apparatus of FIGS. 7 and 8.
Figure 15:
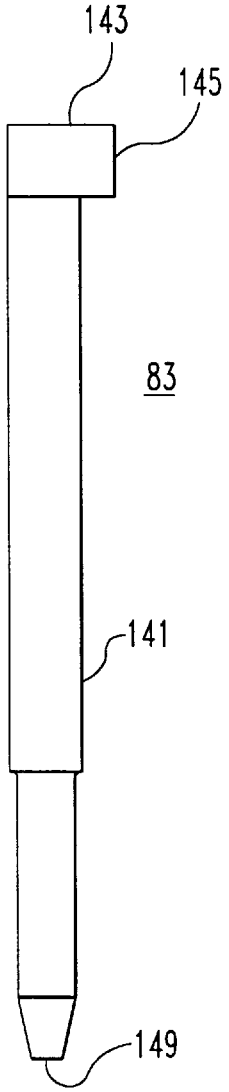
FIG. 15 is a side view of a punch.
Figure 16:
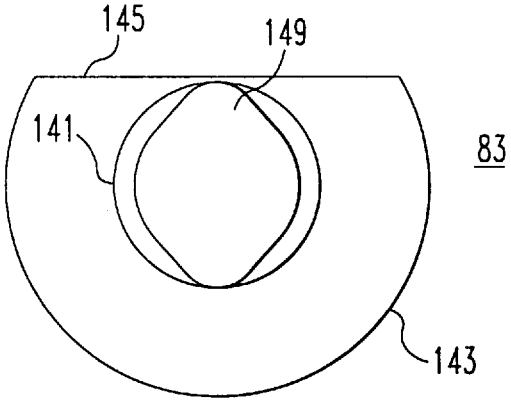
FIG. 16 is an end view of the punch of FIG. 15 shown in enlarged scale.

The die head 81 also includes a punch holder 135, which is a plate having an elongated recess 137 formed in the top surface, as shown in FIG. 11. Seven through bores 139 are aligned in a row in the recess 137. As shown in FIGS. 15 and 16, each punch 83 has an elongated shaft 141 and an enlarged head 143, which is flattened at 145. Returning to FIG. 11, the through holes 139 are off set to the one side of the elongated recess 137. As can be seen in the case of the two punches shown in FIG. 11, the shafts of the punches are inserted through the bores 139 with the flat 145 facing the wider part of the recess. A key 147 then fills the remainder of the recess 137 and bears against the flats 145 on the punches to properly orient the punches which as can be seen in FIGS. 16, are extended laterally on a diameter at the tip 149 to form a roughly diamond-shaped guide which expands the protrusions 67 in the spring clip 53. The punch holder 135 is bolted to the underside of the top die shoe 131.

Figure 10:
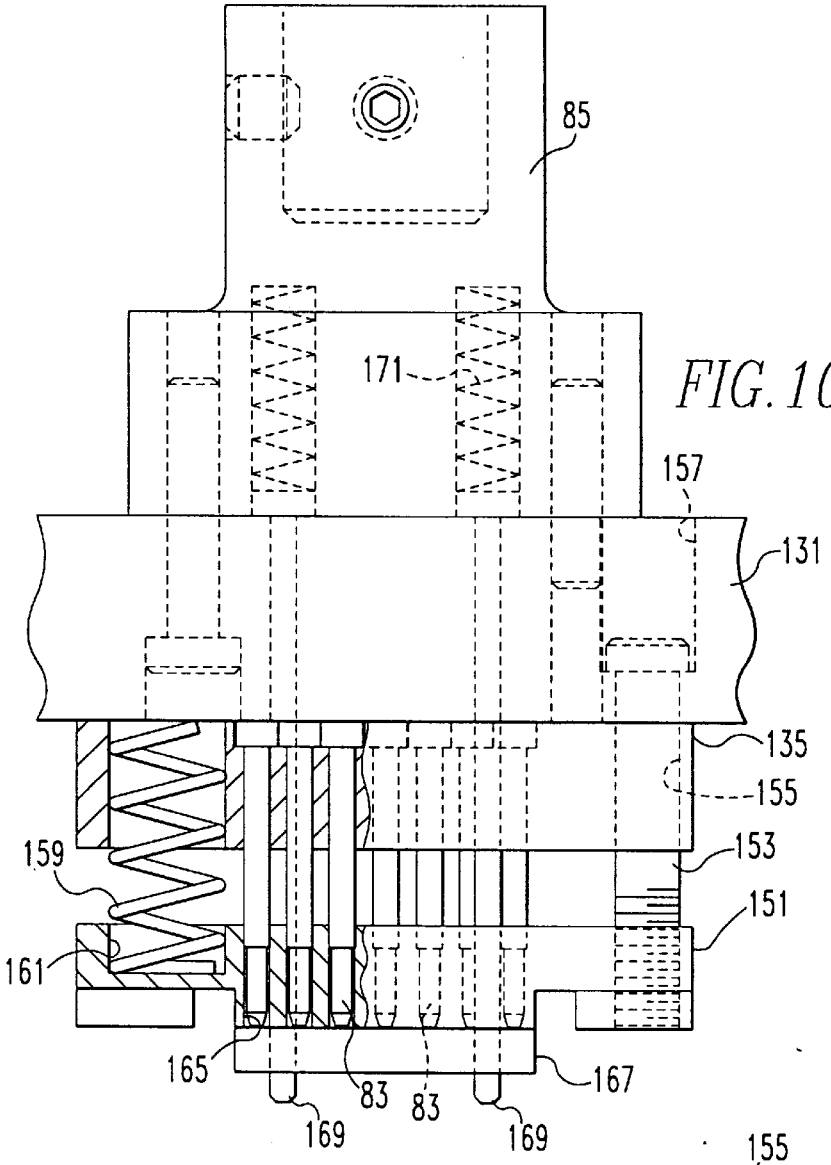
FIG. 10 is an enlarged view of a portion of FIG. 8.

The die head 81 further includes a stripper plate 151 which is supported by four corner bolts 153 extending through bores 155 in the punch holder 135 and captured in counterbored holes 157 in the top die shoe 131 (see, for instance, FIGS. 10 and 11). Four helical compression springs seated in recesses 161 in the stripper plate 151 extend through bores 163 in the punch holder 135 and bear against the top die shoe 131 to bias the stripper plate 151 downward. The punches 83 extend through apertures 165 in the stripper. The stripper pads 151 also has a pair of elongated stripper pads 167 along on either side of the apertures 165 for the punches.

Finally, the die head 81 includes four ejector pins 169 biased downward by helical compression springs 171 seated in the collar 85. These ejector pins extend through the top die shoe 131, the punch holder 135 and the stripper 151, and extend below the stripper pads 167 with the stripper extended.

In operation, the operator withdraws the slide 99 to the loading position by pulling on the slide handle 109. The support block 89 is rotated so that the amperage rating of the circuit breaker in which the contact spring subassembly 49 is to be used is facing the operator. The operator then inserts springs 55 in the spring recesses 93 of the support block 89. The recesses can be color coded to assist in inserting the proper springs in the spring recesses. In addition, the different springs used for the arcing laminations of the contact arm and can be identified by a different color. The support block 89 is secured in the proper position by engaging the locking clamps 102. The springs 55 extend above the top of the support block 89. A spring clip 53 is then turned upside down and placed on top of the springs with the unexpanded protrusions extending into the springs. The operator then pushes the slide 99 forward to the operating position with the slide handle 109. When the proper position is reached, the locking pin 121 will drop into the locking recess 129. In addition, an electrical interlock for preventing operation of the press if the fixture is not properly positioned under the die head 81, includes a micro switch 173 positioned to be actuated by the slide 99 (see FIG. 7). The operator then actuates a palm switch 175 to activate the pneumatic press 71. As the die head 81 is lowered, the stripper pads 167 engage the flanges 63 on the spring clip 53 thereby compressing the contact springs 55. When the spring clip seats on the support block 89, the stripper springs 159 begin to compress and the punch holder 135 continues to descend to drive the punches 83 into the holes 65 in the bottom wall 57 of the spring clip. The eccentric shape of the tips 149 on the punches 83 expands the protrusions 67 to form the interference fit which secures the springs 55 to the spring clip 53. Downward travel of the die head is limited by a pair of stop blocks 177 (see FIG. 8) mounted on the bottom die shoe 79 and which engage the top die shoe 131 at the lower limit of travel.

The pneumatic press 71 then reverses and raises the die head 81. The ejector pins 169 engage the flanges 63 on the spring clip to separate the contact spring subassembly 49 from the stripper 151. The operator then rotates the locking handle 117 downward to disengage the locking pin 121, so that the slide 99 can be withdrawn to the loading position by the slide handle 109. The assembled contact arm spring subassembly 49 is then lifted off of the support block 89 and a new set of springs and spring clip can be loaded for the next cycle.

The subject invention produces a contact arm spring subassembly 49 which makes the assembly of the circuit breaker faster and more reliable. The apparatus 69 generates high production rates of the subassemblies.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a housing;

separable contacts comprising fixed contacts and moveable contacts mounted in said housing;

a moving conductor assembly comprising:

a set of contact arm laminations each having a first end and a second end, said moveable contacts affixed adjacent said first ends; and a contact arm carrier assembly pivotally mounted within said housing on which said contact arm laminations are pivotally mounted adjacent second ends, and having a contact arm spring subassembly including a set of helical contact compression springs and a spring clip supporting said contact springs to bear against said second ends of said contact arm laminations, said spring clip comprising an elongated U-shaped channel member having a bottom wall and side walls forming a trough and with a plurality of pierced holes spaced along said bottom wall forming cylindrical protrusions projecting into said trough, said plurality of springs each being seated on one of said cylindrical protrusions which is expanded to secure the spring to the protrusion; and an operating mechanism pivoting said contact arm carrier assembly to open and close said separable contacts.

* * * * *